US008194505B2

(12) United States Patent
Hirano

(10) Patent No.: US 8,194,505 B2
(45) Date of Patent: Jun. 5, 2012

(54) TIME DISPLAY CONTROL DEVICE, NAVIGATION DEVICE, METHOD FOR CONTROLLING TIME DISPLAYED, AND PROGRAM

(75) Inventor: Hiroyuki Hirano, Anjo (JP)

(73) Assignee: DENSO CORPORATION, Kariya (JP)

( * ) Notice: Subject to any disclaimer, the term of this patent is extended or adjusted under 35 U.S.C. 154(b) by 408 days.

(21) Appl. No.: 12/591,027

(22) Filed: Nov. 5, 2009

(65) Prior Publication Data

US 2010/0135124 A1 Jun. 3, 2010

(30) Foreign Application Priority Data

Nov. 28, 2008 (JP) ..... 2008-303799

(51) Int. Cl.
*G04B 47/06* (2006.01)

(52) U.S. Cl. ..... 368/14; 701/428

(58) Field of Classification Search ..... 368/14; 701/428–429

See application file for complete search history.

(56) References Cited

U.S. PATENT DOCUMENTS

| | | | | |
|---|---|---|---|---|
| 5,323,321 | A * | 6/1994 | Smith, Jr. | 701/428 |
| 5,452,212 | A * | 9/1995 | Yokoyama et al. | 701/428 |
| 5,612,881 | A * | 3/1997 | Moroto et al. | 701/428 |
| 5,724,316 | A * | 3/1998 | Brunts | 368/10 |
| 5,774,828 | A * | 6/1998 | Brunts et al. | 701/428 |
| 6,067,502 | A * | 5/2000 | Hayashida et al. | 701/428 |
| 6,204,772 | B1 * | 3/2001 | DeMay et al. | 340/686.1 |
| 6,297,748 | B1 * | 10/2001 | Lappenbusch et al. | 340/905 |
| 7,480,567 | B2 * | 1/2009 | Suomela et al. | 701/428 |
| 7,966,123 | B2 * | 6/2011 | Watanabe et al. | 701/429 |
| 2007/0176795 | A1 * | 8/2007 | Matsubara | 340/995.1 |
| 2008/0208453 | A1 * | 8/2008 | Fujimoto | 701/202 |

FOREIGN PATENT DOCUMENTS

| | | |
|---|---|---|
| JP | A-09-297191 | 11/1997 |
| JP | A-11-351899 | 12/1999 |
| JP | A-2000-337893 | 12/2000 |
| JP | A-2004-364176 | 12/2004 |
| WO | WO 2007/043398 | 4/2007 |

OTHER PUBLICATIONS

Office Action mailed on Nov. 30, 2010 issued from the Japanese Patent Office in the corresponding Japanese patent application No. 2008-303799 (and English translation).

* cited by examiner

*Primary Examiner* — Sean Kayes
(74) *Attorney, Agent, or Firm* — Posz Law Group, PLC

(57) ABSTRACT

A self-position detecting unit detects a self-position. A time calculating unit calculates a time of a time zone where the self-position detected using the self-position detection unit exists. A time display unit displays the time calculated using the time calculating unit. A display control unit causes the time display unit to display time of the first time zone where the self-position exists continually in an area in a second time zone, which is adjacent to the first time zone, when determining that the self-position moves into the second time zone. The area has a predetermined width from a boundary between the first time zone and the second time zone. The display control unit further causes the time display unit to display time of the second time zone when determining that the self-position moves beyond the area.

8 Claims, 7 Drawing Sheets

TIME DISPLAY CONTROL DEVICE, NAVIGATION DEVICE, METHOD FOR CONTROLLING TIME DISPLAYED, AND PROGRAM

CROSS REFERENCE TO RELATED APPLICATIONS

This application is based on and incorporates herein by reference Japanese Patent Application No. 2008-303799 filed on Nov. 28, 2008.

FIELD OF THE INVENTION

The present invention relates to a time display control device, a navigation device, and a program for automatically correcting and displaying time according to position information and map information. The present invention further relates to a method for controlling time displayed on a display device.

BACKGROUND OF THE INVENTION

An electronic device such as a car-navigation system and a portable personal computer has a clock function for performing various kinds of controls based on time information obtained by the clock function. For example, functions such as time display and estimation of arrival time to a destination in a car-navigation system and time stamp of a file generated in a personal computer are performed based on the time information.

The standard time of each area of a country in the world is determined to have time difference of a multiple number of 1 hour or 30 minutes from the Coordinated Universal Time (UTC: Universal Time Coordinated). For example, Japan is assigned the Japanese standard time (JST: Japan Standard Time), which has time difference from the Coordinated Universal Time and is advanced from the Coordinated Universal Time by 9 hours. Therefore, the Japanese standard time is noted by "+0900 (JST)" or "UTC+9." The standard time is assigned to each predetermined region as a time zone substantially divided in the longitudinal direction in consideration of the rotation axis of the earth. The United States excluding Alaska is divided into four time zones, which are assigned to continuing land. When a person moves from New York (UTC-5) to San Francisco (UTC-8), the person passes through two time zones. New York (UTC-5) and San Francisco (UTC-8) therebetween have time difference of 3 hours.

For example, JP-A-9-297191 discloses an automatic correction device configured to calculate time difference between one time zone and another time zone when moving from the one time zone to the other time zone. The automatic correction device is further configured to automatically correct and change displayed time based on the calculated time difference. In JP-A-9-297191, the automatic correction device detects a self-position based on positioning information obtained using a global positioning system (GPS), determines the time zone where the self position is, and automatically corrects the displayed time based on the time difference information of the time zone. It is conceived to apply the automatic correction device disclosed in JP-A-9-297191 to a system such as a car-navigation system configured to frequently detect the self-position. However, in this case, the displayed time may be frequently changed and corrected whenever the time zone where the self-position changes. Specifically, in a case where a vehicle runs on a road to go beyond a boundary of time zones frequently, for example, the displayed time is frequently changed and corrected. In this case, a user may feel uncomfortable due to frequent correction of the displayed time.

SUMMARY OF THE INVENTION

In view of the foregoing and other problems, it is an object of the present invention to produce a time display control device configured to display time and capable of restricting a user from feeling uncomfortable even when the time display control device frequently goes beyond two time zones. It is another object of the present invention to produce a navigation device having the time display control device. It is another object of the present invention to produce a program relating to the time display control device. It is another object of the present invention to produce a method for controlling time displayed on a display device According to one aspect of the present invention, a time display control device comprises a self-position detecting unit configured to detect a self-position. The time display control device further comprises a time calculating unit configured to calculate time of a first time zone where the self-position detected using the self-position detection unit exists. The time display control device further comprises a time display unit configured to display the time calculated using the time calculating unit. The time display control device further comprises a display control unit configured to: i) cause the time display unit to display time of the first time zone continually in an area in an second time zone, which is adjacent to the first time zone, when determining that the self-position moves into the second time zone, the area having a predetermined width from a boundary between the first time zone and the second time zone; and ii) cause the time display unit to display time of the second time zone when determining that the self-position moves beyond the area.

According to another aspect of the present invention, a navigation device comprises a self-position detecting unit configured to detect a self-position. The time display control device further comprises a time calculating unit configured to calculate time of a self-position time zone where the self-position detected using the self-position detection unit exists. The time display control device further comprises a time display unit configured to display the time calculated using the time calculating unit. The time display control device further comprises a destination setting unit configured to set a destination. The time display control device further comprises a route search unit configured to search a route from a start point to the destination set using the destination setting unit. The time display control device further comprises a display control unit configured to cause the time display unit to display time of a destination time zone where the destination exists continually until arriving at the destination when determining that the self-position moves beyond the boundary and when the route searched using the route search unit intersects a boundary between a start time zone where the start point exists and an adjacent time zone adjacent to the start time zone for a plurality of times.

According to another aspect of the present invention, a method for controlling time displayed on a display device, the method comprises detecting a self-position. The method further comprises calculating time of a first time zone where the self-position exists. The method further comprises calculating time of a second time zone adjacent to the first time zone. The method further comprises determining whether the self-position moves into the second time zone. The method further comprises displaying time of the first time zone continually in an area in the second time zone in response to determination that the self-position moves into the second time zone, the area having a predetermined width from a boundary between the first time zone and the second time zone. The method further comprises displaying time of the second time zone in response to determination that the self-position moves out of the area into an other area in the second time zone.

According to another aspect of the present invention, a method for controlling time displayed on a display device, the method comprises searching a route from a start point to a destination. The method further comprises determining whether the route intersects a boundary between a start time zone where the start point exists and an adjacent time zone adjacent to the start time zone for a plurality of times. The method further comprises detecting a self-position. The method further comprises determining whether the self-position moves beyond the boundary. The method further comprises calculating time of the start time zone. The method further comprises calculating time of a destination time zone where the destination exists. The method further comprises displaying time of the start time zone before determination that the self-position moves beyond the boundary. The method further comprises displaying time of the destination time zone continually until arriving at the destination in response to: determination that the self-position moves beyond the boundary; and determination that the route intersects the boundary for the plurality of times.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
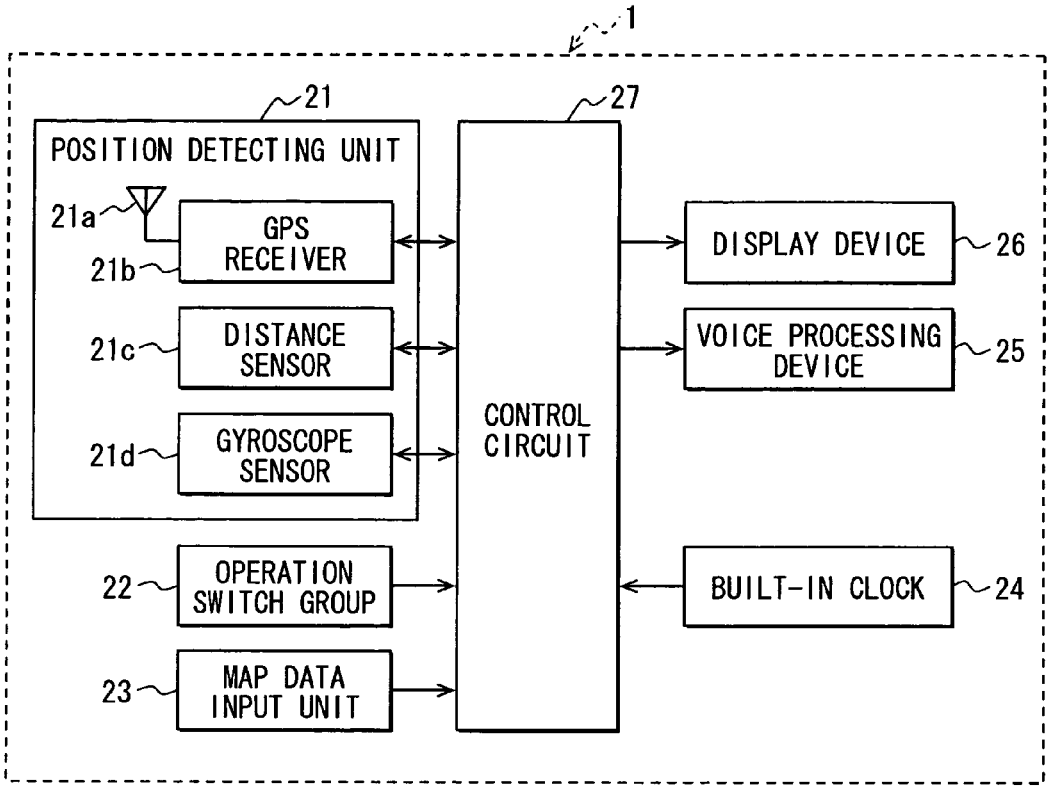
FIG. 1 is a block diagram showing a car navigation device.

In the present embodiment, an example in which a time display control device is applied to a car navigation of a vehicle. FIG. 1 is a block diagram showing a structure of a car navigation device 1 according to the present embodiment. The car navigation device 1 includes a position detecting unit (self-position detecting unit) 21, an operation switch group 22, a map data input unit 23, a built-in clock 24, a display device 26, and a control circuit 27. The position detecting unit 21 detects a current position of a vehicle. The operation switch group 22 is used for inputting various instructions by a user (occupant). The map data input unit 23 has a storage medium for storing various kinds of information items such as map data and a boundary of a time zone. The map data input unit 23 causes a control circuit to input the information items such as map data obtained from the storage medium. The built-in clock 24 generates a reference date and time. A voice processing device 25 outputs various kinds of guidance voice and the like. The display device 26 performs various indications of a map, date and time, and the like. The control circuit 27 performs various operations according to information inputted from the position detecting unit 21, the operation switch group 22, the map data input unit 23, and the built-in clock 24 so as to control the position detecting unit 21, the operation switch group 22, the map data input unit 23, the built-in clock 24, the voice processing device 25, the display device 26, and the like.

The position detecting unit 21 includes a GPS receiver 21*b*, a distance sensor 21*c*, and a gyroscope sensor 21*d*. The GPS receiver 21*b* receives electric wave transmitted from a global positioning system satellite (GPS satellite) via a GPS antenna 21*a* so as to detect the current position (self-vehicle position) of the vehicle and the like. The distance sensor 21*c* detects a travel distance of the vehicle. The gyroscope sensor 21*d* detects a rotary motion applied to the vehicle. Each of the sensors 21*a* to 21*d* has an error caused by difference in the detecting method and character. Therefore, the sensors 21*a* to 21*d* complement errors to each other so as to detect the self-vehicle position. The position detecting unit 21 may employ a part of the sensors 21*a* to 21*d* in consideration of detection accuracy. The position detecting unit 21 may employ a geomagnetism sensor for detecting a traveling direction according to detected geomagnetism, a rotation angle sensor for detecting a rotation angle of a steering wheel, a wheel sensor for detecting rotation of a traveling wheel, and the like.

The operation switch group 22 may include a touch panel, which is integrated with the display device 26 and mounted on a display screen, and a button switch provided around the display device 26. The touch panel and the display device 26 are stacked one another and integrated. The touch panel may employ a pressure-sensitive sensor, an electromagnetic induction sensor, an electric capacity sensor, or a sensor including a combination of two or three of these sensors.

The map data input unit 23 stores various kinds of data in the storage medium of the map data input unit 23 and sends the various kinds of data to the control device. The various kinds of data include road data (network data), coordinate information of a time zone (region), time difference information in each time zone relative to the Coordinated Universal Time, map data, which include data for, map matching so as to enhance accuracy of detection of the current position of the vehicle, facility data, which relates to a facility on the map, and guidance materials such as a picture and voice data. The storage media storing information such as map data may be a read only memory (ROM), a hard disk, a memory or the like.

The voice processing device 25 outputs various kinds of guidance voice based on the picture and the voice data for a guidance operation, which are inputted from the map data input unit 23.

Figure 2:
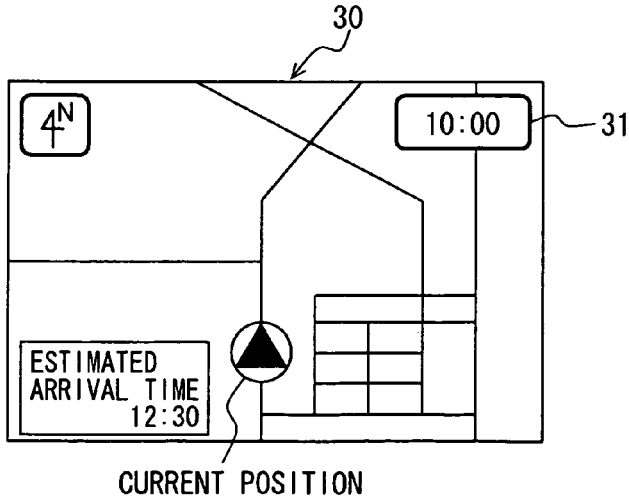
FIG. 2 is an explanatory view showing a display screen of a display device of the car navigation device.

The display device 26 may be a color display device such as a liquid crystal display, a plasma display, a cathode ray tube (CRT), or the like. As shown in FIG. 2, the display device 26 has a display screen 30 indicating a mark, which shows the current position of the vehicle on the map, a guidance route to a destination, an estimated arrival time to the destination, and the like on the map. The mark, the guidance route, and the estimated arrival time are superimposed on the map. The current position of the vehicle on the map is identified based on the current position, which is detected using the position detecting unit 21, and the map data, which is inputted from the map data input unit 23. The present time is displayed on a time display portion 31 in the display screen 30. A sign of various facilities, a name, a mark, a traffic congestion information item, and the like may be superimposed on the map and indicated on the display screen 30.

The control circuit 27 mainly includes a generally-known microcomputer including a CPU, a ROM, a RAM, an I/O device, and the like connected via a bus line. The control circuit 27 executes a program stored in the ROM or the like so as to calculate the current position of the vehicle, which is specified by a group of coordinates and a direction of the vehicle, based on a detection signal inputted from the position detecting unit 21. The control circuit 27 further performs a map indication operation for indicating a map segment, which is close to the current position obtained from the map data input unit 23, a map segment specified by a user by operating the operation switch group 22, and the like on the display device 26. The control circuit 27 further performs a routing assistance operation for assisting a routing operation to automatically calculate an optimal route from the current position to the destination based on the map data stored in the map data input unit 23. The destination is determined according to a facility specified by an operation of the operation switch group 22. The automatic calculation of the optimal route is, for example, performed based on the Dijkstra method.

The control circuit 27 further calculates a time zone of the current position and time difference information, which specifies a difference between the time zone of the current position and the Coordinated Universal Time. The control circuit 27 further calculates the time zone of the current position and the time difference information based on position information obtained from the position detecting unit 21 and the map data obtained from the map data input unit 23. The control circuit 27 obtains the reference time from the built-in clock 24. Specifically, the built-in clock 24 generates the reference time based on the Coordinated Universal Time (UTC) obtained from the GPS device. In this manner, the control circuit 27 is capable of accurately calculating the time in the current position based on the time difference information between the reference time in the current time zone and the Coordinated Universal Time. In this way, the time calculated by the control circuit 27 is displayed as the current time on the time display portion 31 in the display screen 30 of the display device 26. The display device 26 and the time display portion 31 are equivalent to a time display unit, and the control circuit 27 is equivalent to a display control unit.

Figure 3:
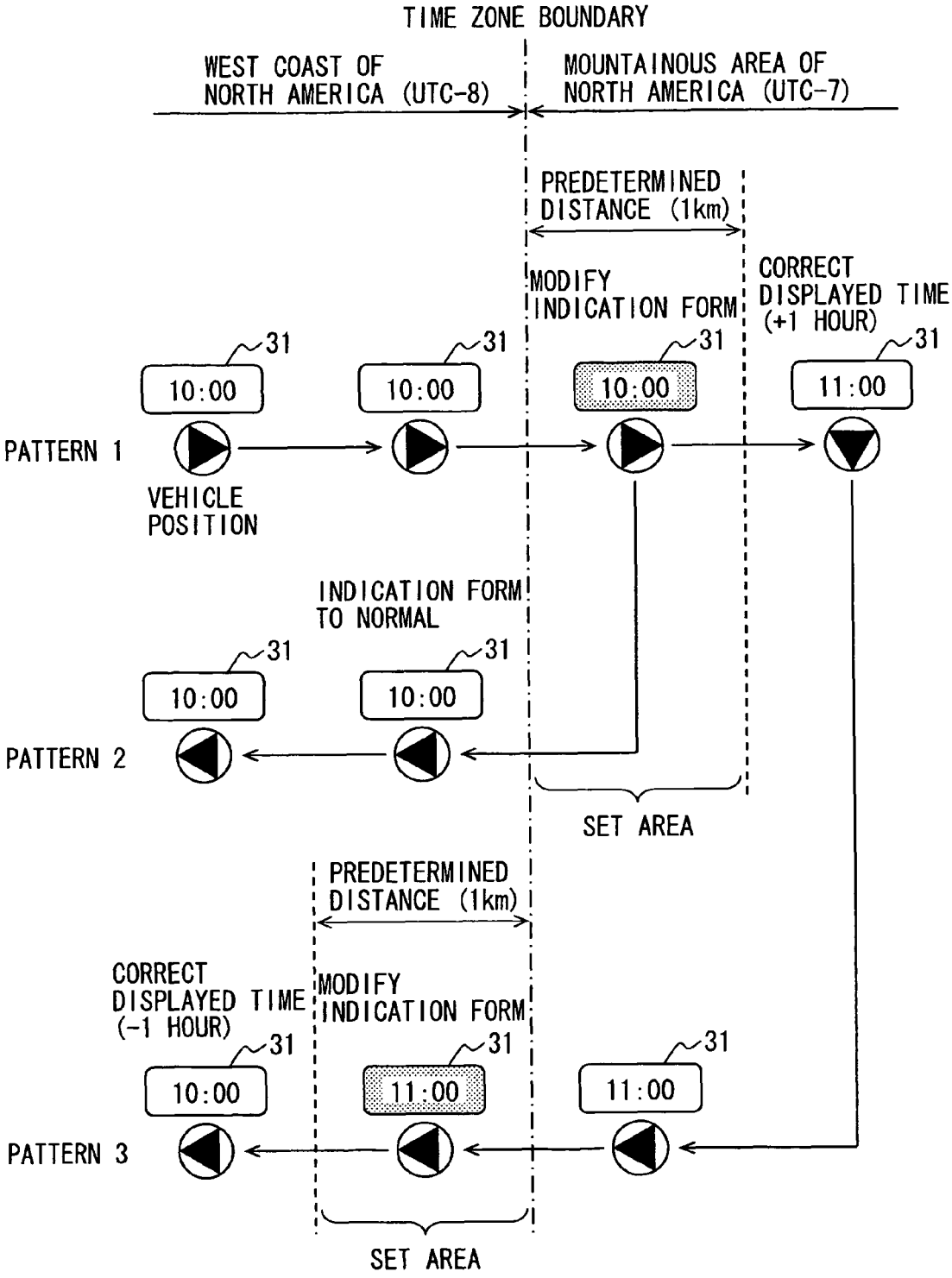
FIG. 3 is an explanatory view showing an operation of the car navigation device according to a first embodiment.

Subsequently, a processing performed by the control circuit 27 for displaying the time when the vehicle goes beyond the time zone will be described with reference to FIG. 3. In the drawing, the time in a west coast of North America is 10:00, and the time in a mountainous region of North America is 11:00 for simplifying the explanation of the processing. Nevertheless, in fact, the time in each area progresses with travel time of the vehicle.

First, a pattern 1 where the vehicle moves from the west coast of North America (UTC-8) to the mountainous region of North America (UTC-7) will be described. In the present pattern 1, when the vehicle goes from the west coast of North America beyond a time zone boundary, an area is set at the side of the mountainous region of North America. The presently set area has the width of a predetermined distance from the time zone boundary. In consideration of a positioning accuracy of the GPS device, a shape of the road when the vehicle runs on the road along the time zone boundary, and the like, the predetermined distance of the presently set area is beforehand set to a value such as 1 km (1 kilometer) such that a user does not feel incongruity. The value may be changed in dependence upon an environment of the user and may be arbitrary set by the user. When the vehicle exists in the set area, the time display portion 31 continually displays the time of the west coast of North America. At this time, an indication form of the time display portion 31 is modified. The modification of the indication form may be performed by, for example, modifying a background color of the time display portion 31 or blinking the time in the time display portion 31. The modification of the indication form will be described later in detail.

When the vehicle goes beyond the set area, the time displayed on the time display portion 31 is changed and corrected to the time in the time zone of the mountainous region of North America. At this time, the indication form of the time display portion 31 is corrected to a normal form before the modification. As follows, an example of the automatic correction (automatic change) in the time displayed on the time display portion 31 will be described. First, the time zone where the vehicle exists is stored. Subsequently, a first difference between the time zone in the west coast of North America where the vehicle existed before the time correction and the Coordinated Universal Time is calculated. Subsequently, a second difference between the time zone in the mountainous region of North America where the vehicle presently exists after the time correction and the Coordinated Universal Time is calculated. Subsequently, a deviation between the first difference and the second difference is calculated. Finally, the deviation is subtracted from the time displayed. More specifically, when the vehicle moves from the west coast of North America (UTC-8) to the mountainous region of North America (UTC-7), the difference in the time difference between both the time zones and the Coordinated Universal Time is calculated by $-8-(-7)=-1$. When the time displayed is 10:00, the difference in the time difference is calculated by $10-(-1)=11$. Consequently, the time displayed after the time correction is 11:00. Thus, the right time in the present time zone where the vehicle moved can be displayed. Alternatively, the automatic correction of the time displayed may be performed by adding the time difference in the time zone where the vehicle exists after the time correction to the reference time of the built-in clock 24. Further alternatively, a communication device such as a cellular phone may be used for obtaining the right time by communicating with a relay station, which exists in the time where the vehicle came beyond the boundary of the time zone. The set area, which was previously set, is canceled after the automatic time correction so as to prohibit further automatic time correction caused by going beyond a boundary of the previously set area at the opposite side of the boundary of the time zone.

Subsequently, a pattern 2 where the vehicle returns to the west coast of North America (UTC-8) without going beyond the set area in the mountainous region of North America (UTC-7) will be described. In the present pattern, the time display portion 31 continually displays the time of the west coast of North America. The indication form of the time display portion 31 is once modified in the set area in the mountainous region of North America and returned to the normal form after the vehicle returns to the west coast of North America beyond the boundary of the time zone.

Subsequently, a pattern 3 where the vehicle returns to the west coast of North America (UTC-8) after going beyond the set area in the mountainous region of North America (UTC-7)

will be described. In the present pattern 3, when the vehicle returns to the west coast of North America after going beyond the time zone boundary, an area is set at the side of the west coast of North America. The presently set area has the width of a predetermined distance from the time zone boundary. Further, similarly to the pattern 1, in the presently set area, the time of the mountainous region of North America is continually displayed, and the indication form of the time display portion 31 is modified. Subsequently, when the vehicle goes beyond the presently set area, the time displayed is corrected to the time of the west coast of North America, and the indication form of the time display portion 31 is returned to the normal form.

Subsequently, the method for the time correction and the modification of the indication form will be described with reference to the flow charts of FIGS. 4, 5. The processings shown in the flow charts are performed by executing the computer program stored in the control circuit 27.

Figure 4:
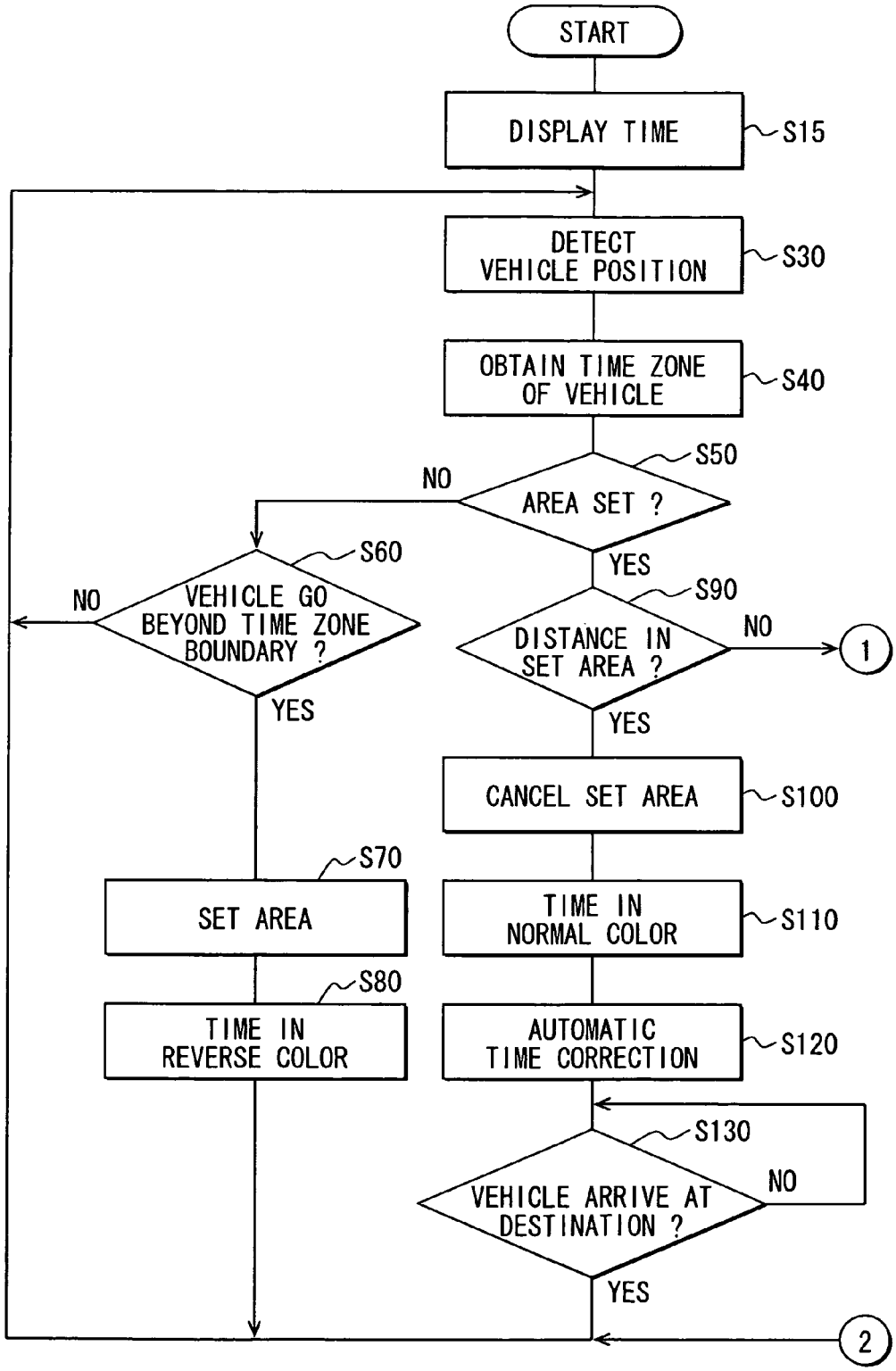
FIG. 4 is a flow chart showing a processing for time display according to the first embodiment.
Figure 5:
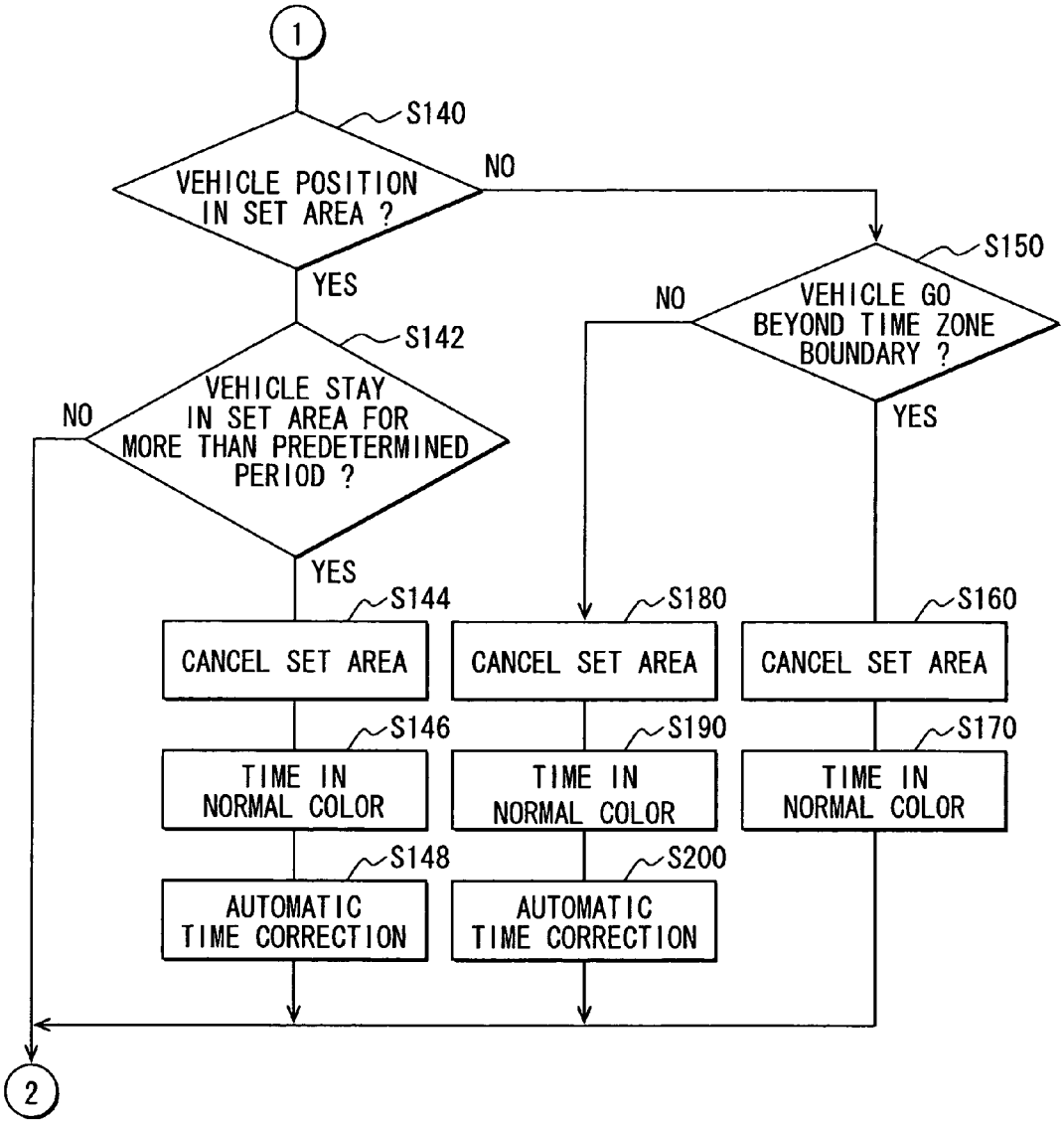
FIG. 5 is a flow chart showing a processing for the time display according to the first embodiment.
Figure 6A:
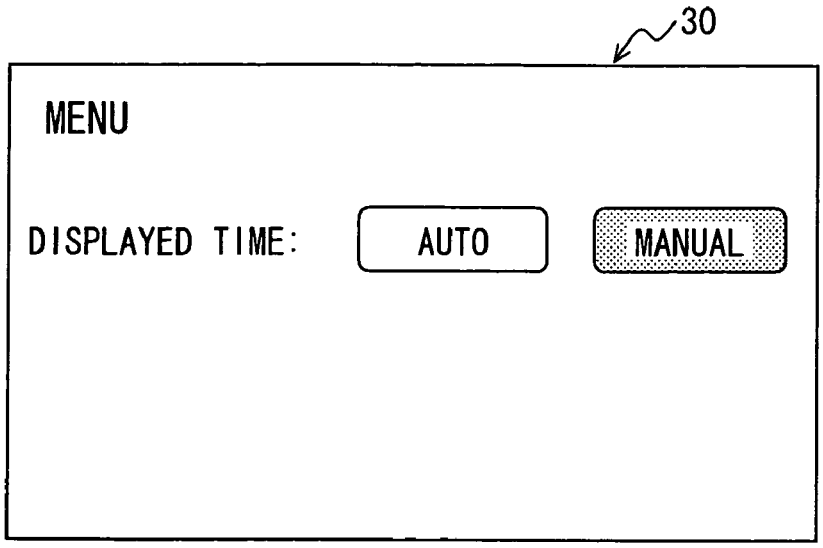
FIGS. 6A, 6B are explanatory views each showing an automatic or manual configuration of time display.
Figure 6B:
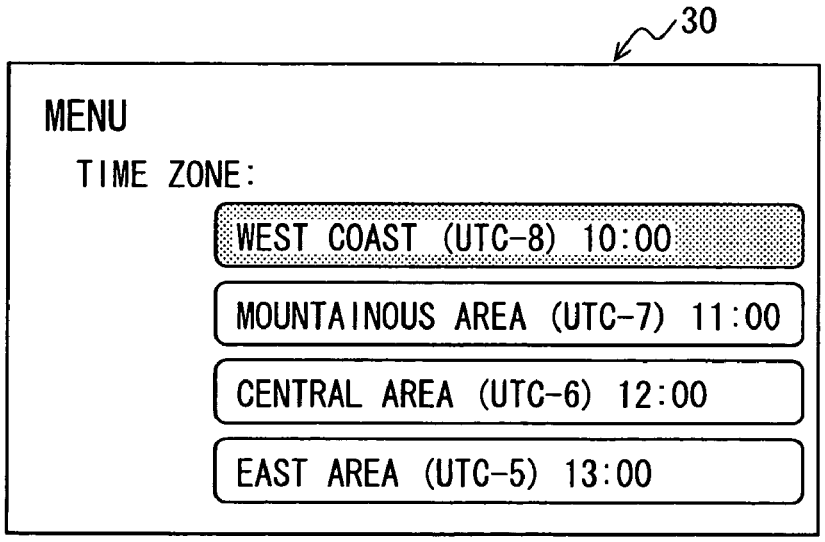

First, at step S15 in FIG. 4, the time display portion 31 of the display device 26 of the car navigation device 1 is caused to display the time. As shown in FIG. 6A, the time displayed may be automatically set, may be manually set by a user, or may be manually obtained. When the time displayed is automatically set, as described above, the time may be set according to the reference time, which is generated by the built-in clock 24, and the time difference information, which includes the difference between the Coordinated Universal Time and the time of the time zone where the vehicle currently exists. As shown in FIG. 6B, when the time displayed is manually obtained, a user may select a time zone to obtain the time displayed.

At step S30, the current position of the vehicle is detected based on information obtained from the position detecting unit 21. At step S40, the time zone where the vehicle exists is obtained based on the information of the position of the vehicle and the map data obtained from the map data input unit 23. The time zone where the vehicle exists can be obtained by (i) beforehand associating the time zone as coordinate data with map data and (ii) comparing the coordinates of the vehicle position with the associated coordinate data of the time zone.

At step S50, it is determined whether the area is set. Specifically, it is determined whether an area is set based on determination whether a set area flag is ON or OFF. When an area is not set at step S50, step S50 makes a negative determination, and the present processing proceeds to step S60. Alternatively, when an area is set at step S50, step S50 makes a positive determination, and the present processing proceeds to step S90.

At step S60, it is determined whether the vehicle goes beyond the boundary of the time zone. That is, it is determined whether the time zone where the vehicle exists is changed. The present determination can be made by determining whether the time zone where the vehicle exists is changed, the time zone being obtained at step S40. When the time zone is not changed, step S60 makes a negative determination, and the processing returns to step S30. That is, a loop of the processing is repeated, and the present condition is maintained, until the vehicle goes beyond the time zone boundary. When it is determined that the vehicle goes beyond the time zone boundary, step S60 makes a positive determination, and the processing proceeds to step S70. At step S70, the area, which has the width of the predetermined distance from the time zone boundary, is set, and the set area flag is set to ON.

Figure 7:
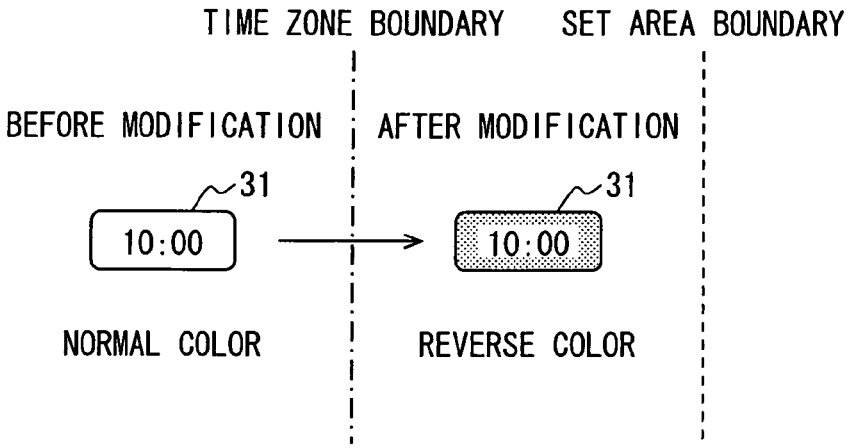
FIG. 7 is an explanatory view showing modification of an indication form of a time display portion according to the first embodiment.

At subsequent step S80, as shown in FIG. 7, the background color of the time display portion 31 of the display screen 30 is reversed from white to black, and the color of the time is reversed from black to white. That is, after the vehicle goes beyond the time zone boundary, the background color is modified to black, and the color of the time is modified to white. The modification of the indication form is not limited to the reverse of the indication color. For example, the time display portion 31 may blink the indication. Alternatively, only the color of the numeral parts of the time may be modified. The notification to the user is not limited to a visual effect such as the modification of the indication. For example, the voice processing device 25 may cause voice to notify a user of the vehicle going beyond the time zone boundary. For example, the voice processing device 25 may cause a voice announcement that the vehicle is running in the vicinity of the time zone boundary. Thus, the processing returns to step S30 after the indication form of the time display portion 31 is modified. After the area is set at step S70, step S50 makes a positive determination, and the processing proceeds to step S90.

At the step S90, it is determined whether a destination exists in the set area. The destination is specified by a user by manipulating the operation switch group 22. When the destination exists in the set area, step S90 makes a positive determination, and the processing proceeds to step S100. Alternatively; when the destination does not exist in the set area, step S90 makes a negative determination, and the processing proceeds to step S140 (FIG. 5).

Figure 8:
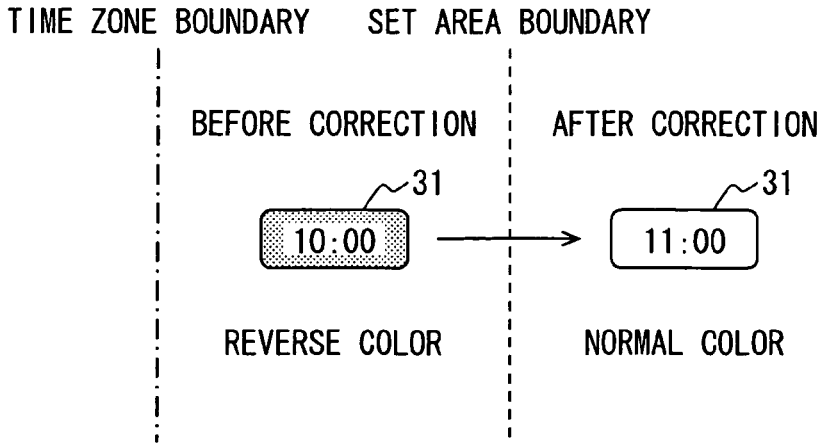
FIG. 8 is an explanatory view showing correction of the time displayed on the time display portion according to the first embodiment.

At step S100, the area, which is set at step S70, is canceled. At the time, the set area flag is set to OFF. Subsequently, the processing proceeds to step S110 where the reversed color of the time is returned to a normal color before the modification. Further, the processing proceeds to step S120 where the time displayed is changed and corrected. Specifically, as shown in FIG. 8, the corrected time in the normal color is displayed on the time display portion 31. At this time, the voice processing device 25 may cause voice to notify the user of the time zone change. Thus, the processing proceeds from step S120 to step S130.

At step S130, it is determined whether the vehicle arrives at the destination. When the vehicle arrives at the destination, step S130 makes a positive determination, and the processing returns to step S30. Until the vehicle arrives at the destination, step S130 repeats making a negative determination, and the present condition is maintained at step S130.

Subsequently, at step S140 in FIG. 5, it is determined whether the position of the vehicle is in the set area. Specifically, coordinate data of each set area is beforehand associated with the map data. Further, the coordinate data of the set area, which is set at step S70, is compared with the coordinate data of the position of the vehicle, and thereby it is determined whether the position of the vehicle is in the set area. Alternatively, a distance between the position of the vehicle and the time zone boundary may be calculated, and it may be determined whether the distance is less than a predetermined distance so as to determine whether the position of the vehicle is in the set area. When the position of the vehicle exists in the set area, step S140 makes a positive determination, and the processing proceeds to step S142. Alternatively, when the vehicle goes beyond the set area, step S140 makes a negative determination, and the processing proceeds to step S150.

At step S142, it is determined whether the vehicle stays in the set area for a period greater than or equal to a predetermined period. The predetermined period may be set to 1 hour or may be arbitrary set by a user. When it is determined that the vehicle stays in the set area for a period greater than or equal to the predetermined period, step S142 makes a positive determination, and the processing proceeds to step S144. Alternatively, when it is determined that the vehicle stays in the set area for a period less than the predetermined period, step S142 makes a negative determination, and the processing returns to step S30. In this case, the reversed color of the time display portion 31 of the display device 26 is maintained in the condition where it is determined that the vehicle stays in the set area for a period less than the predetermined period and the processing between step S142 and step S30 is repeated.

At step S144, the area, which is set at step S70, is canceled. At the time, the set area flag is set to OFF. Subsequently, the processing proceeds to step S146 where the reversed color of the time is returned to the normal color before the modification. Further, the processing proceeds to step S148 where the time displayed is changed and corrected. Specifically, as shown in FIG. 8, the corrected time in the normal color is displayed on the time display portion 31. Subsequently, the processing proceeds to step S30.

At step S150, it is determined whether the vehicle goes beyond the boundary of the time zone. The determination at step S150 is made for determining whether the present condition is the pattern 2 or the pattern 1 in FIG. 3. That is, the determination at step S150 is made for determining whether the vehicle returns to the time zone after going beyond the time zone boundary or the vehicle goes beyond the set area through the time zone boundary. Similarly to step S60, the determination at S150 is made based on determination whether the time zone where the vehicle exists is changed. When it is determined that the vehicle goes beyond the time zone, step S150 makes a positive determination. That is, when the vehicle returns to the time zone after going out of the set area, in the pattern 2 of FIG. 3, the processing proceeds to step S160 where the set area set at step S70 is canceled. At the time, the set area flag is set to OFF. Subsequently, the processing proceeds to step S170 where the reversed color of the time is returned to the normal color, and the processing returns to step S30.

Alternatively, when it is determined that the vehicle does not go beyond the time zone, step S150 makes a negative determination. That is, when the vehicle returns to the time zone after going out of the set area, in the pattern 1 of FIG. 3, the processing proceeds to step S180 where the set area set at step S70 is canceled. At the time, the set area flag is set to OFF. Subsequently, the processing proceeds to step S190 where the reversed color of the time is returned to the normal color before the modification. Further, the processing proceeds to step S200 where the time displayed is corrected. Subsequently, the processing proceeds to step S30.

According to the present first embodiment, the set area is specified, and thereby the time displayed on the time display portion 31 of the display device 26 is not corrected, as long as the vehicle is in the set area even in a condition where the vehicle frequently passes alternatively two time zones around the time zone boundary. Whereby, a user does not feel uncomfortable due to frequent correction of the time displayed due to frequent correction in the time zone of the vehicle. Furthermore, the indication form of the time display portion 31 is modified in the set area and thereby notifying a user of the vehicle going beyond the time zone without time correction. In this case, the indication form may be modified by, for example, reversing the color of the time display portion 31, modifying only the color of the numeral parts of the time, blinking the time, and/or the like. The notification to the user is not limited to a visual effect such as the modification of the indication. For example, the voice processing device 25 may cause voice to notify a user of the vehicle going beyond the time zone boundary. For example, the voice processing device 25 may cause a voice announcement that the vehicle is running in the vicinity of the time zone boundary.

Further, in the condition where the destination exists in the set area, the time is corrected when the vehicle goes beyond the time zone boundary. In this case, the corrected time is continually displayed on the time display portion 31 until at least the vehicle arrives at the destination. Thereby, in the condition where the destination exists in the set area, displaying of the time in the first time zone can be prohibited when a user and the vehicle arrive at the destination. Thus, in this case, the time in the second time zone where the destination exists can be properly displayed.

Further, when the vehicle exists in the set area for a period more than a predetermined period, the time of the time display portion 31 may be automatically corrected. The predetermined period may be arbitrarily determined. When the vehicle exists in the set area for more than the predetermined period, it is determined that the time zone does not frequently change. Therefore, in this case, it is conceived that a user do not feel uncomfortable due to the time correction.

Modification of First Embodiment

Modifications of first embodiment will be described, as follows.

When the vehicle exists in the set area, and when the time correction is performed, the time display portion 31 may display the time in the second time zone, in response to an instruction of a user. The user may cause the instruction by manipulating the operation switch group 22, pressing the time display portion 31 of the touch-panel screen, or the like. Alternatively, the modification of the indication form of the time may be cancelled, and the indication form may be returned to the normal form. Thus, the time of the first time zone, which is currently displayed on the time display portion 31, may be continually displayed. In this manner, the time can be displayed according to user's preference.

In the above embodiment, the area, which has the width of the predetermined distance from the time zone boundary, is set and canceled. Alternatively, the area may be predetermined. In this case, the time correction may be automatically performed when the vehicle goes beyond the set area after the vehicle goes beyond the time zone boundary of the set area.

Further, when an active area of a user is mainly around a user's house and a user's business area, a user may prefer to indicate the time on the time display portion 31 in a fixed time zone. For such a user, who prefers to indicate the time in the fixed time zone, the device may have an optional function such that the user can activate and deactivate the automatic time correction. Specifically, when the automatic time correction is deactivated, and when the vehicle goes beyond the time zone boundary, a user can be notified of change in the time zone by modification of the indication form of the time display portion 31. Further, when the indication form of the time is modified, the time displayed on the time display portion 31 may be corrected to the time of the second time zone according to a user's instruction. The user's instruction may be caused by, for example, pressing of the time display portion 31 of the touch-panel screen of the display device 26. Alternatively, as shown in FIG. 6B, a user, who is notified of change in the time zone by the notification, may manually perform the time correction by newly selecting a time zone. After the time correction, the indication form of the time display portion 31 returns to the normal form.

Second Embodiment

As follows, the second embodiment will be described. The structure of the car navigation device according to the present embodiment is substantially equivalent to that of the first embodiment, and a detailed description of the structure is omitted. In the first embodiment, the set area is set. In the present embodiment, contrary to the first embodiment, when the vehicle goes beyond the time zone boundary, the time display portion 31 continually displays the time in the time zone where the destination exists until the vehicle arrives at the destination. As follows, an operation of the present embodiment will be described with reference to the flow chart of FIG. 9.

Figure 9:
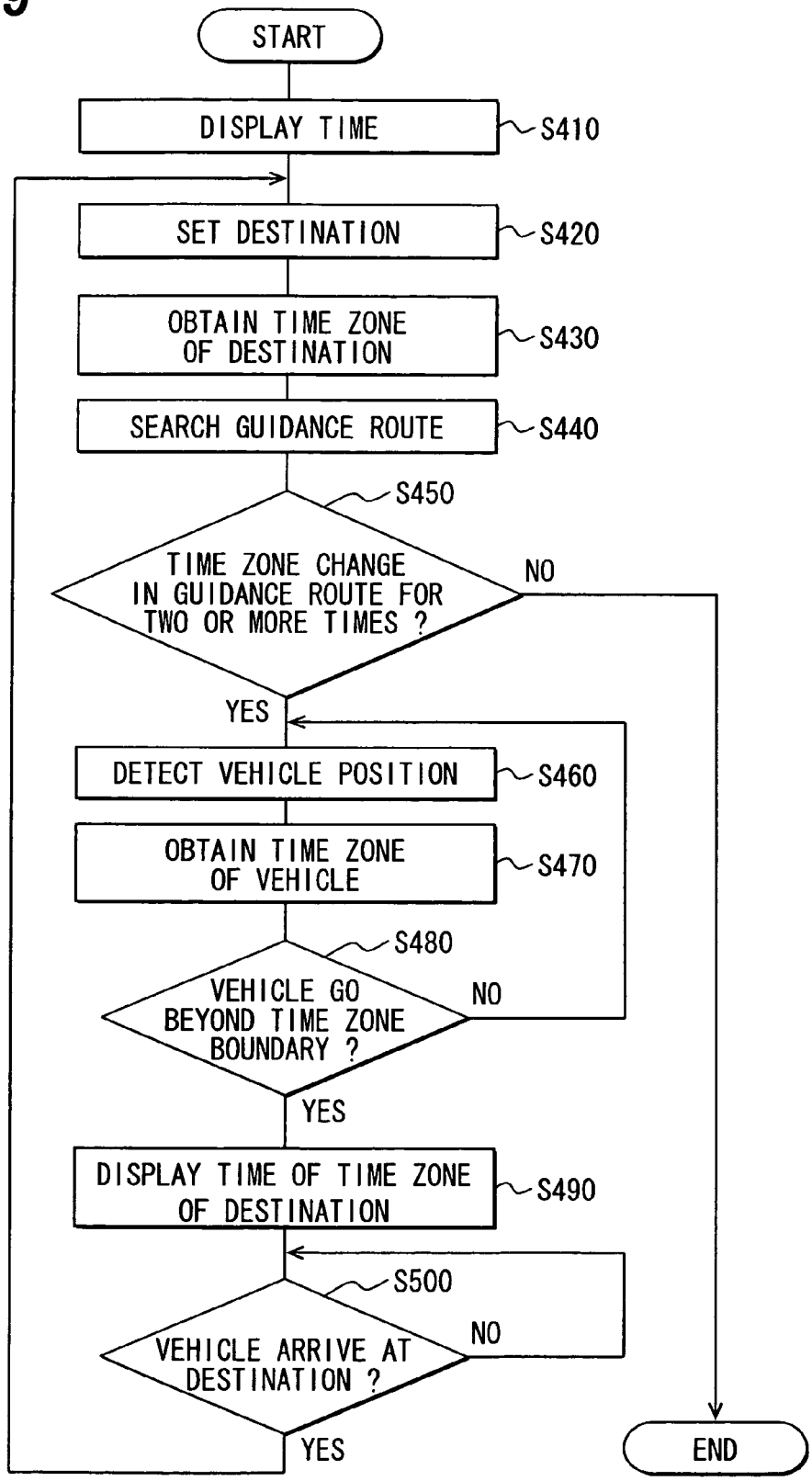
FIG. 9 is a flow chart showing a processing for the time display according to a second embodiment.

First, at step S410 in FIG. 9, the time display portion 31 of the display device 26 of the car navigation device 1 is caused to display the time. At step S420, a user sets a destination by manipulating the operation switch group 22. Subsequently, at step S430, a time zone where the destination is set at step S420 is determined. At step S440, a guidance route from a start point to the destination is searched.

At subsequent step S450, it is determined whether the time zone where the vehicle exists is changed for two or more times on the guidance route searched at step S440. That is, at step 450, it is determined whether the guidance route intersects, i.e., goes beyond the boundary between the time zone where the start point exists and an adjacent time zone for two or more times. When the time zone is not changed for two or more times, step S450 makes a negative determination. In this case, the processing is terminated. In this case, when the vehicle goes beyond a time zone boundary, the time displayed on the time display, portion 31 is corrected. However, the vehicle moving on the guidance route is not supposed to go beyond the time zone boundary for two or more times. Therefore, a user does need not feel uncomfortable due to frequent correction of the time displayed. Alternatively, when the time zone is changed for two or more times in the guidance route, step S450 makes a positive determination. In this case, the processing proceeds to step S460.

At step S460, the position of the vehicle is detected. At subsequent step S470, the time zone where the vehicle exists is obtained. At step S480, it is determined whether the vehicle goes beyond the time zone boundary. When it is determined that the vehicle goes beyond the time zone boundary, step S480 makes a positive determination, and the processing proceeds to step S490. Step S480 repeats making a negative determination until the vehicle goes beyond the time zone boundary. That is, the loop of step S460 to step S480 is repeated, and the present condition is maintained, until the time zone of the position of the vehicle is changed.

At step S490, the time display portion 31 displays the time of the time zone where the destination exists. As described in the first embodiment, the time correction can be performed by calculating a difference between the first time difference of the time in the time zone where the vehicle exists before the vehicle goes beyond the time zone boundary from the Coordinated Universal Time and the second time difference of the time in the time zone where the destination exists from the Coordinated Universal Time, and subtracting the difference from the time displayed. Alternatively, the time in the time zone of the destination may be obtained using a communication unit, and the obtained time may be displayed on the time display portion 31. At subsequent step S500, it is determined whether the vehicle arrives at the destination. Until the vehicle arrives at the destination, step S500 makes a negative determination, and the time display portion 31 continually displays the time of the time zone of the destination. When the vehicle arrives at the destination, step S500 makes a positive determination, and the processing returns to step S420.

According to the present second embodiment, even in a condition where the vehicle frequently goes beyond a time zone boundary before the vehicle arrives at the destination, the time display portion 31 of the display device 26 displays the time of the time zone where the destination exists when the vehicle goes beyond a time zone boundary. That is, the time display portion 31 continually displays the time of the time zone where the destination exists until the vehicle arrives at the destination. Thereby, a user does not feel uncomfortable due to the time correction and the time display.

Other Embodiment

In the above embodiments, the time display control device is applied to the car navigation device. It is noted that the application of the time display control device is not limited to a car navigation device, and various forms can be employed as long as the time display control device and other features belong to a technical scope of the present invention. For example, the time display control device may be applied to a movable apparatus, which needs the time correction to correct the time difference according to the area where the time display control device moves. The movable apparatus may be a portable car navigation device, a watch, a clock, a portable personal computer, and the like. The time display control device may be applied to a time display device of a mobile communications apparatus such as a cellular phone and a walkie-talkie.

Summarizing the above embodiments, a self-position detecting unit is configured to detect a self-position, and a time display unit is configured to display a time of a self-position time zone where the detected self-position is located. A display control unit is configured to: i) cause the time display unit to display a time of the first time zone continually in an area in a second time zone, which is adjacent to the first time zone, when the self-position moves into the second time zone, the area having a predetermined distance from a boundary between the first time zone and the second time zone; and ii) cause the time display unit to display a time of the second time zone when determining that the self-position moves beyond the area, i.e., the self-position moves out of the area.

In the present time display control device, even in a condition where the time display control device frequently and alternatively passes a boundary between two time zones, the time displayed is not corrected in the area. Whereby, a user does not feel uncomfortable due to frequent correction of the time displayed. The predetermined distance, which specifies the area, may be predetermined in consideration of a positioning accuracy of a GPS device and a shape of a road when the time display control device moves on the road along the boundary of the time zones.

When the self-position is in the area, an indication form of the time may be modified. The modification of the indication form may be performed by modifying an indication color of the time display unit, blinking the time display unit, or the like. Thus, a user can be notified of the self-position moving in the area after passing the boundary of the time zone. Thus, the user can recognize that the user is moving near the boundary.

When the self-position is in the area for more than a predetermined period, the displayed time may be corrected and the time of the second time zone may be displayed. When the time display control device exists in the area for more than the predetermined period, it is determined that the time zone is not frequently changed. Therefore, in this case, it is conceived that a user do not feel uncomfortable due to the correction of the time.

Even when the self-position is in area, the time displayed may be corrected to the time of the second time zone in response to an instruction of a user. In this manner, the time can be displayed according to user's preference.

A navigation device includes the time display control device, a destination setting unit, a route guide unit, which guides a route to the destination. The display control unit corrects the time displayed to the time of the second time zone when the destination is set in the area and when the navigation device goes beyond the boundary of the time zone. The display control unit causes the time display unit to continually display the time after the correction until arriving at the destination at least. Thereby, in the condition where the destination is set in the set area, displaying of the time in the first time zone can be prohibited when a user arrives at the destination. Thus, in this case, the time in the second time zone where the destination, exists can be properly displayed.

In the navigation device, a self-position is detected using a self-position detection unit, a time of the time zone where the self-position exists is calculated by a time calculating unit, the time calculated using the time calculating unit is displayed on the time display unit, and a destination is set using a destination setting unit. A route from a start point to the destination is searched using a route search unit. The display control unit causes the time display unit to display the time of the time zone where the destination exists when the route search unit searches a route, which intersects a boundary between a time zone, where the self-position is located, and an adjacent time zone for multiple times, and when determining that the self-position goes beyond the boundary between the time zones. In addition, the display control unit causes the time display unit to continually display the time of the time zone where the destination exists until arriving at the destination. Thus, even when the navigation device frequently moves beyond the boundary between two time zones, the time of the time zone where the destination is continually displayed on the time display unit until arriving at the destination. Therefore, a user do not feel uncomfortable.

A program product can function as the display control unit of the time display control device when executed by a computer of the time display control device.

The above structures of the embodiments can be combined as appropriate.

The above processings such as calculations and determinations are not limited being executed by the control circuit 27. The control unit for performing the processings may have various structures including the control circuit 27 shown as an example.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A time display control device comprising:

a self-position detecting unit configured to detect a self-position;

a time calculating unit configured to calculate time of a first time zone where the self-position detected using the self-position detection unit exists;

a time display unit configured to display the time calculated using the time calculating unit; and a display control unit configured to:

i) cause the time display unit to display time of the first time zone continually in an area in an second time zone, which is adjacent to the first time zone, when determining that the self-position moves into the second time zone, the area having a predetermined width from a boundary between the first time zone and the second time zone; and ii) cause the time display unit to display time of the second time zone when determining that the self-position moves beyond the area, wherein the display control unit is configured to modify an indication form of the time display unit and display the time on the time display unit in the area.

2. The time display control device according to claim 1, wherein the display control unit is configured to modify the indication form by modifying a color of the time display unit or blinking indication of the time display unit.

3. The time display control device according to claim 1, wherein the display control unit is configured to cause the time display unit to display time of the second time zone in the area when a predetermined period elapses after determining that the self-position moves beyond the boundary.

4. The time display control device according to claim 1, wherein the display control unit is configured to cause the time display unit to display time of the second time zone in the area in response to an instruction of a user.

5. The navigation device according to claim 1, further comprising:

a destination setting unit configured to set a destination; and a route guide unit configured to guide a route from a start point to the destination set using the destination setting unit, wherein the display control unit is configured to cause the time display unit to display time of the second time zone continually until arriving at the destination when determining that the self-position moves beyond the boundary and when determining that the destination, which is set using the destination setting unit, exists in the area.

6. A computer readable medium comprising instructions being executed by a computer, the instructions for causing the computer to function as the display control unit of the time display control device according to claim 1.

7. A program product comprising instructions being executed by a computer, the instructions for causing the computer to function as the display control unit of the time display control device according to claim 1.

8. A time display control device comprising:

a self-position detecting unit configured to detect a self-position;

a time calculating unit configured to calculate time of a first time zone where the self-position detected using the self-position detection unit exists;

a time display unit configured to display the time calculated using the time calculating unit;

a display control unit configured to:

i) cause the time display unit to display time of the first time zone continually in an area in an second time zone, which is adjacent to the first time zone, when determining that the self-position moves into the second time zone, the area having a predetermined width from a boundary between the first time zone and the second time zone; and ii) cause the time display unit to display time of the second time zone when determining that the self-position moves beyond the area;

a destination setting unit configured to set a destination; and a route guide unit configured to guide a route from a start point to the destination set using the destination setting unit, wherein the display control unit is configured to cause the time display unit to display time of the second time zone continually until arriving at the destination when determining that the self-position moves beyond the boundary and when determining that the destination, which is set using the destination setting unit, exists in the area.

* * * * *